US010201819B2

(12) United States Patent
Wang

(10) Patent No.: US 10,201,819 B2
(45) Date of Patent: Feb. 12, 2019

(54) ADJUSTABLE COATING AND CLEANING GUN

(71) Applicant: Gen Chong Wang, Yongkang (CN)

(72) Inventor: Gen Chong Wang, Yongkang (CN)

( * ) Notice: Subject to any disclaimer, the term of this patent is extended or adjusted under 35 U.S.C. 154(b) by 0 days.

(21) Appl. No.: 15/785,490

(22) Filed: Oct. 17, 2017

(65) Prior Publication Data

US 2018/0111141 A1 Apr. 26, 2018

(30) Foreign Application Priority Data

Oct. 25, 2016 (CN) ..... 2016 2 1163218 U

(51) Int. Cl.

| | |
|---|---|
| ***B05B 7/04*** | (2006.01) |
| ***B05B 7/24*** | (2006.01) |
| ***B08B 5/02*** | (2006.01) |
| ***B05B 9/01*** | (2006.01) |
| ***B08B 3/02*** | (2006.01) |
| *B05B 12/00* | (2018.01) |

(52) U.S. Cl.

CPC ..... *B05B 7/2459* (2013.01); *B05B 9/01* (2013.01); *B08B 3/028* (2013.01); *B08B 5/02* (2013.01); *B05B 12/002* (2013.01)

(58) Field of Classification Search

CPC ..... B05B 7/2459; B05B 12/002; B05B 9/01; B05B 3/028; B05B 3/14; B05B 3/16; B08B 5/02

USPC ..... 239/318, 346, 355, 369, 371, 526, 227, 239/229

See application file for complete search history.

(56) References Cited

U.S. PATENT DOCUMENTS 1,588,756 A * 6/1926 Leigh ..... B05B 1/3046 239/369
2,835,533 A * 5/1958 Baker ..... A01M 7/0089 239/129
2,966,198 A * 12/1960 Wylde ..... A24D 3/022 118/303
3,072,342 A * 1/1963 MacFarland ..... B05B 7/2437 239/346
4,044,953 A * 8/1977 Vogel ..... B05B 1/10 137/179
4,611,759 A * 9/1986 Cox ..... B01F 5/02 239/229
4,804,144 A * 2/1989 Denman ..... B05B 7/2408 222/630
5,533,673 A * 7/1996 Wilson ..... B05B 3/00 239/227
6,003,787 A * 12/1999 Fisher ..... A01M 7/0017 239/355
6,883,732 B2 * 4/2005 Hasegawa ..... B05B 3/00 239/318
7,878,423 B2 * 2/2011 Hasegawa ..... B05B 1/26 239/229

(Continued)

*Primary Examiner* — Christopher Kim
(74) *Attorney, Agent, or Firm* — Wayne & Ken, LLC; Tony Hom

(57) ABSTRACT

The utility model discloses an adjustable coating cleaning gun, comprising a gun body, a trigger switch and a cleaning solution storage kettle, wherein a cleaning spray head is fixed to a gun head of the gun body; a spray pipe joint is fixed to a gun head air passage of the gun body; a swinging spray pipe is arranged in the cleaning spray head; the swinging spray pipe is a hollow elliptical pipe; a long axis of a section of the hollow elliptical pipe is longitudinally arranged, and a short axis is horizontally arranged.

6 Claims, 2 Drawing Sheets

(56) References Cited

U.S. PATENT DOCUMENTS

| | | | | |
|---|---|---|---|---|
| 8,336,789 | B2 * | 12/2012 | Kuo | B05B 3/022 239/226 |
| 8,353,467 | B2 * | 1/2013 | Hasegawa | B05B 3/00 239/227 |
| 8,857,737 | B2 * | 10/2014 | Chen | B05B 3/06 239/302 |
| 8,864,051 | B2 * | 10/2014 | Lin | B05B 3/0409 239/240 |
| 9,475,071 | B2 * | 10/2016 | Endo | B05B 3/022 |
| 9,623,427 | B2 * | 4/2017 | Gilpatrick | B05B 1/34 |
| 2010/0282866 | A1 * | 11/2010 | Gilpatrick | B05B 1/34 239/310 |

* cited by examiner

ADJUSTABLE COATING AND CLEANING GUN

CROSS-REFERENCE

This application claims priority to Chinese Patent Application No. 201621163218.X, filed Oct. 25, 2016.

TECHNICAL FIELD

The utility model relates to a cleaning tool, and in particular to an adjustable coating and cleaning gun which can be used for blow washing and coating.

BACKGROUND

For the convenience of cleaning dust on automobile or workpiece surfaces, a used cleaning tool is required to be used for cleaning and dust absorption. For example, a Chinese patent 028301978 discloses a nozzle and a spray apparatus. The structure provides a dual-purpose gun for blowing dust and cleaning to blow dust and clean automobiles or workpieces. When compressed air is used alone, air is sprayed from a spray head to remove granular powder dust and dust on the automobile or workpiece surfaces. When the compressed air and the cleaning solution are used simultaneously, the cleaning solution is sucked out by negative pressure through the compressed air and sprayed to a dirt part at high pressure for decontamination.

However, the dual-purpose gun with the above structure has the following defects during use: 1. the convolutional swinging amplitude of a free end of an outer nozzle is in direct proportion with the size of pressure of the compressed air; an air pump with large pressure is required to be supplied; a cleaning point cannot be accurately aligned during use; a cleaning scope cannot be controlled according to requirements; and cleaning speed and quality are directly influenced. 2. The automobile or workpiece surfaces cannot be subjected to coating processing such as waxing, oiling and the like in the existing dual-purpose gun. In view of the above problems, many manufacturers and people of vision specially conduct development and manufacture, but no ideal product emerges so far.

SUMMARY

To overcome the above defects in the existing dual-purpose gun for dust removal and cleaning, the purpose of the utility model is to provide an adjustable coating and cleaning gun with simple and reasonable structure, convenient operation and use, adjustable cleaning scope, high cleaning speed and good working environment.

A technical solution adopted for solving the above technical problems in the utility model is as follows: the adjustable coating and cleaning gun comprises a gun body, a trigger switch and a cleaning solution storage kettle, wherein a cleaning spray head is fixed to a gun head of the gun body; a spray pipe joint is fixed to a gun head air passage of the gun body; a swinging spray pipe is arranged in the cleaning spray head; the swinging spray pipe is a hollow elliptical pipe made of flexible material; a long axis of a section of the hollow elliptical pipe is vertically arranged, and a short axis is horizontally arranged; vertical rigidity of the swinging spray pipe is higher than horizontal rigidity so that the swinging spray pipe can only swing in a horizontal direction during operation; one end of the hollow elliptical pipe is fixedly connected with the spray pipe joint, and the other end is a free end and is fixed with a horizontal swinging eccentric sleeve; a cleaning solution capillary spray pipe is arranged in the swinging spray pipe; and the cleaning solution capillary spray pipe penetrates through the spray pipe joint and is communicated with the cleaning solution storage kettle.

In a further solution of the utility model, circular pipes are also arranged on both ends of the hollow elliptical pipe; one end is fixedly connected with the spray pipe joint through the circular pipe; and the horizontal swinging eccentric sleeve is fixed to the circular pipe on the other end.

In a further solution of the utility model, the free end of the swinging spray pipe extends from the cleaning spray head.

In a further solution of the utility model, an adjusting movable sleeve sleeved on the swinging spray pipe and used for controlling the swinging spray pipe to swing in the horizontal direction is arranged in the cleaning spray head; an adjusting tank is arranged on the cleaning spray head; and a screw rod of a locking knob penetrates through the adjusting tank on the cleaning spray head and is connected with the adjusting movable sleeve.

After the above structure is adopted, compared with the prior art, the utility model has the following advantages: 1. the swinging spray pipe is a hollow elliptical pipe made of flexible material; a long axis of a section of the hollow elliptical pipe is vertically arranged, and a short axis is horizontally arranged; and vertical rigidity of the swinging spray pipe is greatly higher than horizontal rigidity. Therefore, the swinging spray pipe can only swing in a horizontal direction during operation, thereby realizing accurate positioning of a cleaning surface, good cleaning quality, high efficiency and effortless and convenient cleaning. 2. The fore-and-aft position of the adjusting movable sleeve can be adjusted through the locking knob, and the swinging amplitude of the swinging spray pipe can be controlled, thereby achieving the purpose of adjustable and controllable cleaning angle and scope. 3. The utility model can be used as a dust blowing gun, a blow washing gun and a coating gun, and has multiple applications and wide use scope.

In the figures: 1 horizontal swinging eccentric sleeve; 2 swinging spray pipe; 3 cleaning spray head; 4 adjusting tank; 5 locking knob; 6 trigger switch; 7 gun body; 8 valve switch; 9 cleaning solution storage kettle; 10 cleaning solution capillary spray pipe; 11 adjusting movable sleeve; and 12 spray pipe joint.

DETAILED DESCRIPTION

Figure 1:
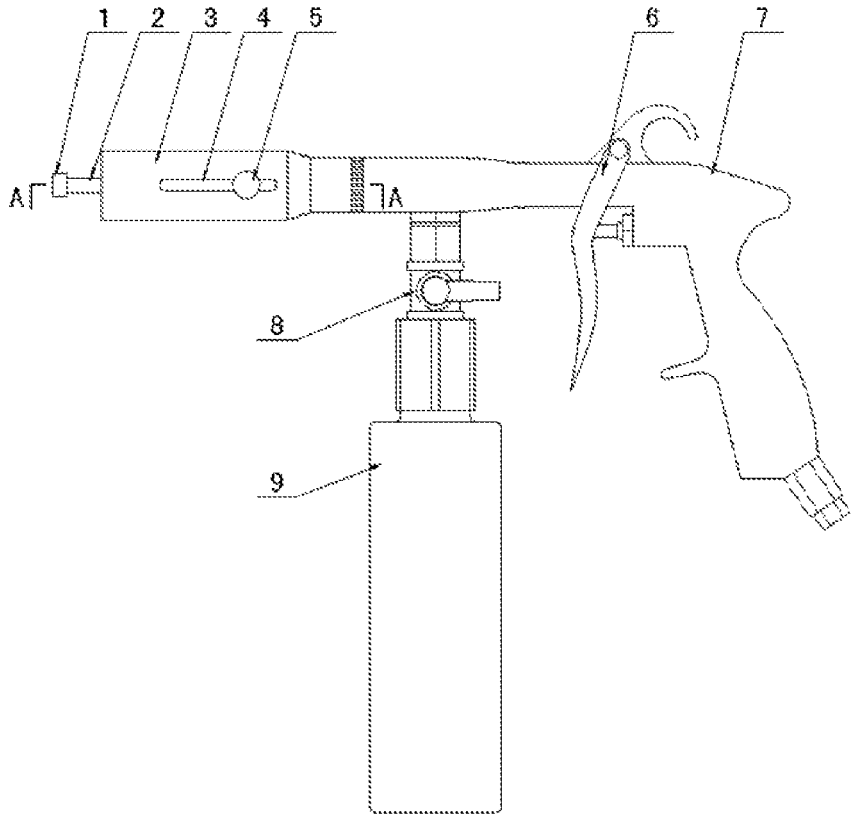
FIG. 1 is a schematic diagram of a main structure of the utility model.
Figure 2:
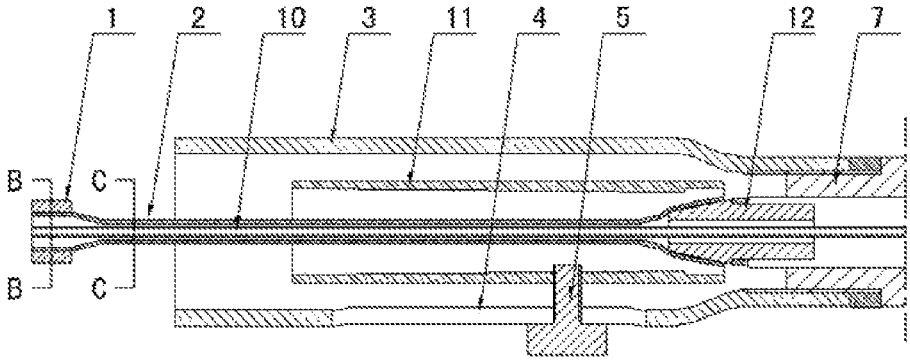
FIG. 2 is a schematic diagram of an A-A sectional structure in FIG. 1 of the utility model.
Figure 3:
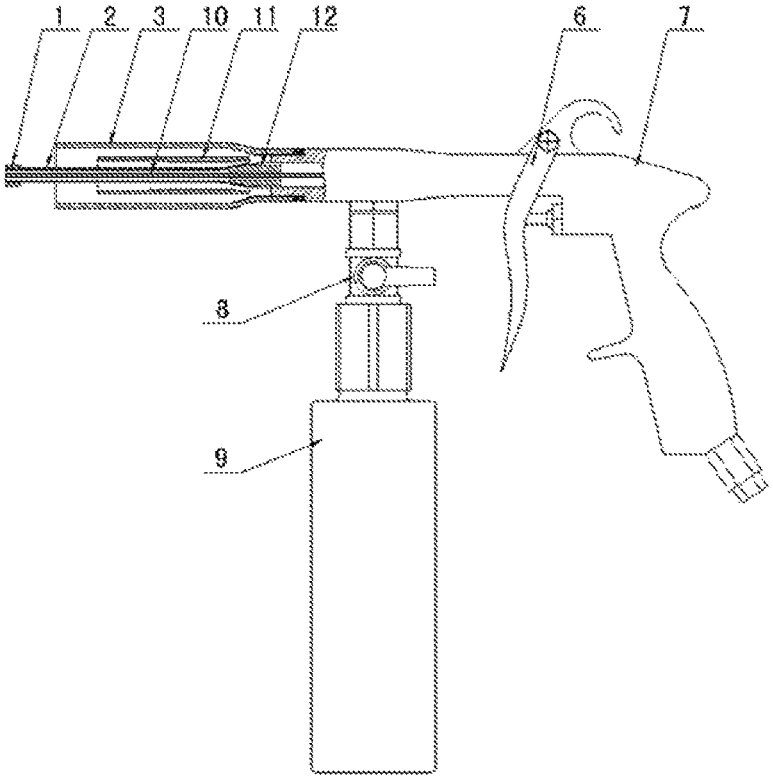
FIG. 3 is a schematic diagram of a matching structure of the utility model.
Figure 4:
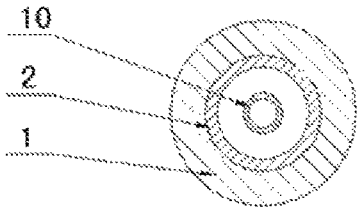
FIG. 4 is a schematic diagram of a B-B sectional structure in FIG. 2 of the utility model.
Figure 5:
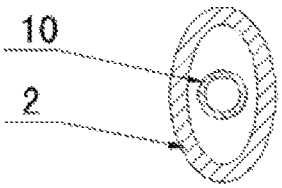
FIG. 5 is a schematic diagram of a C-C sectional structure in FIG. 2 of the utility model.

FIG. 1 to FIG. 5 show specific implementation solutions of an adjustable coating and cleaning gun of the utility model. The adjustable coating and cleaning gun is mainly used for blowing dust and cleaning and comprises a gun body 7, a trigger switch 6, a valve switch 8 and a cleaning solution storage kettle 9, wherein a cleaning spray head 3 is fixed to a gun head of the gun body 7; a spray pipe joint 12 is fixed to a gun head air passage of the gun body 7; a swinging spray pipe 2 is arranged in the cleaning spray head 3; the swinging spray pipe 2 is a hollow elliptical pipe made of flexible material; a long axis of a section of the hollow elliptical pipe is vertically arranged, and a short axis is horizontally arranged; vertical rigidity of the swinging spray pipe 2 is higher than horizontal rigidity so that the swinging spray pipe 2 can only swing in a horizontal direction during operation; one end of the hollow elliptical pipe is fixedly connected with the spray pipe joint 12, and the other end is a free end and is fixed with a horizontal swinging eccentric sleeve 1; a cleaning solution capillary spray pipe 10 is arranged in the swinging spray pipe 2; and the cleaning solution capillary spray pipe 10 penetrates through the spray pipe joint 12 and is communicated with the cleaning solution storage kettle 9. The free end of the swinging spray pipe 2 extends from the cleaning spray head 3. An adjusting movable sleeve 11 sleeved on the swinging spray pipe 2 and used for controlling the swinging spray pipe 2 to swing in the horizontal direction is arranged in the cleaning spray head 3; an adjusting tank 4 is arranged on the cleaning spray head 3; and a screw rod of a locking knob 5 penetrates through the adjusting tank 4 on the cleaning spray head 3 and is connected with the adjusting movable sleeve 11.

To facilitate fixed connection, circular pipes are also arranged on both ends of the hollow elliptical pipe; one end is fixedly connected with the spray pipe joint 12 through the circular pipe; and the horizontal swinging eccentric sleeve 1 is fixed to the circular pipe on the other end.

When compressed air is used alone, air is sprayed from the swinging spray pipe 2 to remove granular powder dust and dust on automobile or workpiece surfaces, so that the adjustable coating and cleaning gun is mainly used as the dust blowing gun. When the adjustable coating and cleaning gun is used as the blow washing gun, the compressed air and the cleaning solution are used simultaneously. The cleaning solution is sucked out by negative pressure through the compressed air and sprayed to a dirt part at high pressure for decontamination. The fore-and-aft position of the adjusting movable sleeve 11 can be adjusted through the locking knob 5, and the cleaning angle of the swinging spray pipe 2 can be controlled, thereby achieving the purpose of adjustable and controllable cleaning angle and scope. When a coating solution is installed on the cleaning solution storage kettle 9, automobile or workpiece surfaces can be subjected to coating processing.

The above only describes specific embodiments of the utility model, not intended to limit the utility model in any form. Simple amendments, equivalent changes or modifications made on the basis of not deviating from the technical solution of the utility model fall into a protection scope of the utility model.

What is claimed is:

1. An adjustable coating and cleaning gun, comprising a gun body, a trigger switch and a cleaning solution storage kettle;

wherein a cleaning spray head is fixed to a gun head of the gun body; a spray pipe joint is fixed to a gun head air passage of the gun body; a swinging spray pipe is arranged in the cleaning spray head; the swinging spray pipe is a hollow elliptical pipe made of flexible material; a long axis of a section of the hollow elliptical pipe is vertically arranged, and a short axis is horizontally arranged; a vertical rigidity of the swinging spray pipe is higher than that of a horizontal rigidity so that the swinging spray pipe only swings in a horizontal direction during operation; one end of the hollow elliptical pipe is fixedly connected with the spray pipe joint, and the other end is a free end and is fixed with a horizontal swinging eccentric sleeve; a cleaning solution capillary spray pipe is arranged in the swinging spray pipe; and the cleaning solution capillary spray pipe penetrates through the spray pipe joint and is communicated with the cleaning solution storage kettle.

2. The adjustable coating and cleaning gun according to claim 1, wherein circular pipes are also arranged on both ends of the hollow elliptical pipe; one end is fixedly connected with the spray pipe joint through the circular pipe; and the horizontal swinging eccentric sleeve is fixed to the circular pipe on the other end.

3. The adjustable coating and cleaning gun according to claim 2, wherein an adjusting movable sleeve sleeved on the swinging spray pipe and used for controlling the swinging spray pipe to swing in the horizontal direction is arranged in the cleaning spray head; an adjusting tank is arranged on the cleaning spray head; and a screw rod of a locking knob penetrates through the adjusting tank on the cleaning spray head and is connected with the adjusting movable sleeve.

4. The adjustable coating and cleaning gun according to claim 1, wherein the free end of the swinging spray pipe extends from the cleaning spray head.

5. The adjustable coating and cleaning gun according to claim 4, wherein an adjusting movable sleeve sleeved on the swinging spray pipe and used for controlling the swinging spray pipe to swing in the horizontal direction is arranged in the cleaning spray head; an adjusting tank is arranged on the cleaning spray head; and a screw rod of a locking knob penetrates through the adjusting tank on the cleaning spray head and is connected with the adjusting movable sleeve.

6. The adjustable coating and cleaning gun according to claim 1, wherein an adjusting movable sleeve sleeved on the swinging spray pipe and used for controlling the swinging spray pipe to swing in the horizontal direction is arranged in the cleaning spray head; an adjusting tank is arranged on the cleaning spray head; and a screw rod of a locking knob penetrates through the adjusting tank on the cleaning spray head and is connected with the adjusting movable sleeve.

* * * * *